United States Patent [19]

Gange

[11] 4,308,486

[45] Dec. 29, 1981

[54] LINE CATHODE STRUCTURE HAVING RECESSED GEOMETRY

[75] Inventor: Robert A. Gange, Belle Mead, N.J.

[73] Assignee: RCA Corporation, New York, N.Y.

[21] Appl. No.: 98,171

[22] Filed: Nov. 27, 1979

[51] Int. Cl.[3] ..... H01J 29/74

[52] U.S. Cl. ..... 313/422; 313/446

[58] Field of Search ..... 313/422, 446

[56] References Cited

U.S. PATENT DOCUMENTS 3,226,587 12/1965 Chin .
3,492,531 1/1970 Owaki et al. .
3,531,681 9/1970 Harden .
3,588,600 6/1971 Nakagama et al. .
3,621,319 11/1971 Heynisch et al. .

*Primary Examiner*—Palmer C. Demeo
*Assistant Examiner*—Darwin R. Hostetter
*Attorney, Agent, or Firm*—Eugene M. Whitacre; Glenn H. Bruestle; Lester L. Hallacher

[57] ABSTRACT

A flat panel display device having a plurality of electron propagation channels utilizes a line cathode. The cathode extends across all the channels and modulation electrodes associated with the channels cause the cathode to emit the electrons into the spaces between parallel guide meshes within the propagation channels. The cathode and modulation electrodes are arranged in a recessed cavity in the proximity of launch electrodes so that the electrons are emitted at high velocity into the propagation channels to travel curved paths along which the electron beams are converged into the spaces between the guide meshes. Electron propagation structure within the channels, therefore, is displaced from the cathode so that the cathode heat has a substantially reduced effect on the propagation structure, and the high electron velocity minimizes the effect of mechanical tolerances on the electron beam.

15 Claims, 4 Drawing Figures

LINE CATHODE STRUCTURE HAVING RECESSED GEOMETRY

BACKGROUND OF THE INVENTION

This invention relates generally to flat panel display devices having line cathodes and particularly to a line cathode and modulation electrode structure for use in such devices.

U.S. Pat. No. 4,121,130 shows a line cathode structure in combination with a slotted electrode. The cathode is positioned parallel to the slot and the cathode and slot lie in the plane of a space between two guide meshes along which electron beams are propagated. Electrons emitted by the cathode and travelling toward the slot pass through the slot and enter into the space between the guide meshes. Electrons which do not pass through the slot impinge on with the slotted electrode. Positioned along the cathode is a plurality of electrode pads which are arranged so that the cathode lies between the pads and the slot. By applying a positive potential to the slotted electrode and as a less positive potential to one or more of the pads, electron emission can be made to occur at selected positions along the cathode. Accordingly, the single line cathode effectively functions as a plurality of small cathodes each being controlled by a single pad.

U.S. Pat. No. 4,128,784 shows a flat panel display device having a line cathode. The cathode is positioned along a space between two parallel guide meshes along which electron beams are propagated. A series of electrodes is arranged in pairs along the cathode so that the cathode is positioned between the electrodes of each pair. The guide meshes are biased at a positive potential and the electrodes are biased more negative than the cathode. Under these biasing conditions electrons emitted by the cathode are injected into the space between the guide meshes.

U.S. Pat. No. 4,088,920 to W. W. Siekanowicz, et al. entitled "Flat Panel Display Device With Beam Guide", describes a beam guide for use in flat panel cathodoluminescent display devices. The display is composed of an evacuated envelope containing a plurality of internal support walls which divide the envelope into a plurality of parallel channels. Each channel contains a beam guide extending along one wall of the envelope. An electron gun structure emits electrons which are launched into the beam guides as electron beams. The beam guides include a pair of spaced parallel plates extending along and spaced from the backwall of the envelope. The plates contain a plurality of aligned apertures which are arranged in columns extending longitudinally along the propagation paths of the beams. Each longitudinal column of apertures constitutes a separate beam guide. The apertures also are arranged in rows transversely of the guides. One line of the visual display is generated by ejecting the electron beams out of the guide through the apertures in a single row.

SUMMARY OF THE INVENTION

In an electron gun for providing electrons to an electron receiving means a cathode is used as an electron source. Modulation electrodes, in the vicinity of the cathode, control emission of electrons from the vicinity of the cathode. The cathode and modulation electrodes are arranged in a recessed cavity so that the cathode is displaced from the plane containing the electron receiving means. Launch electrodes cause electrons leaving the recessed cavity to travel curved paths along which the beam uniquely converges to the electron receiving means substantially independently of the biasing potentials on the modulation electrodes.

DETAILED DESCRIPTION OF THE PREFERRED EMBODIMENT

Figure 1:
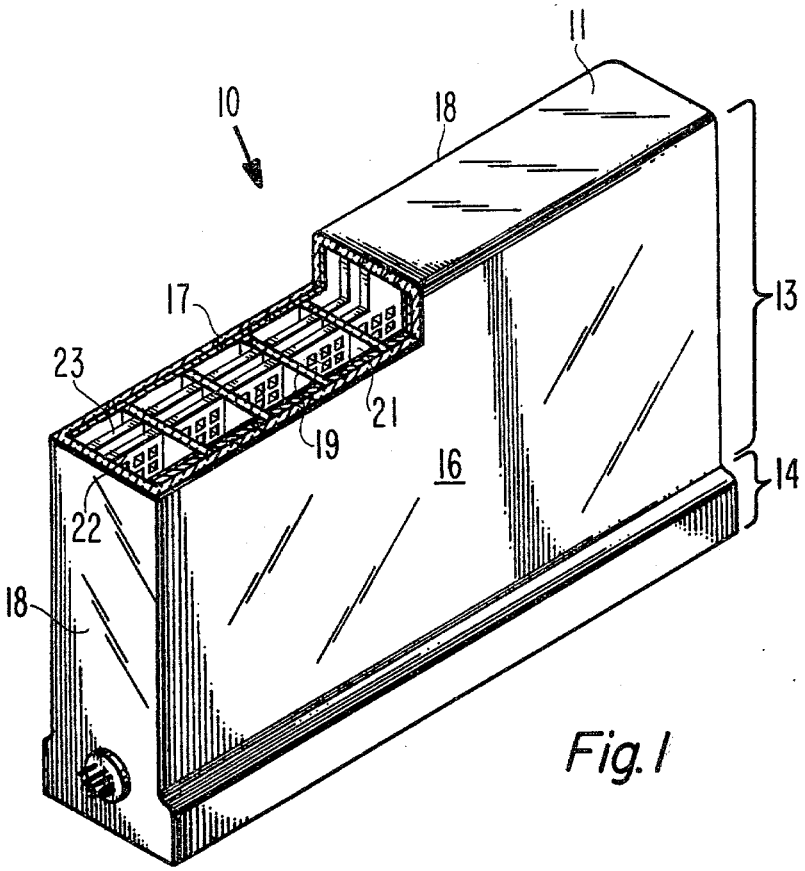
FIG. 1 is a perspective view, partially broken away, of a prior art flat panel display device in which the invention can be used.

FIG. 1 shows one form of a flat panel display device in which the present invention can be utilized. The display device is generally designated as 10 and includes an evacuated envelope 11 having a display section 13 and an electron gun section 14. The envelope 11 includes a rectangular frontwall 16 and a rectangular backwall 17 in spaced parallel relationship with the frontwall 16. The frontwall 16 and the backwall 17 are connected by four sidewalls 18.

A plurality of spaced parallel support vanes 19 are secured between the frontwall 16 and the backwall 17 and extend from the gun section 14 to the opposite sidewall 18. The support vanes 19 provide the desired internal support against external atmospheric pressure and divide the envelope 11 into a plurality of channels 21. Each of the channels 21 encloses a beam guide assembly for propagating electron beams along the channels 21. The beam guide assemblies include a pair of spaced parallel beam guide meshes 22 and 23 extending transversely across the channels and longitudinally along the channels from the gun section 14 to the opposite sidewall 18. The construction and operation of the display device 10, shown in FIG. 1, are fully described in U.S. Pat. No. 4,088,920 and the other patents referenced herein above.

Figure 2:
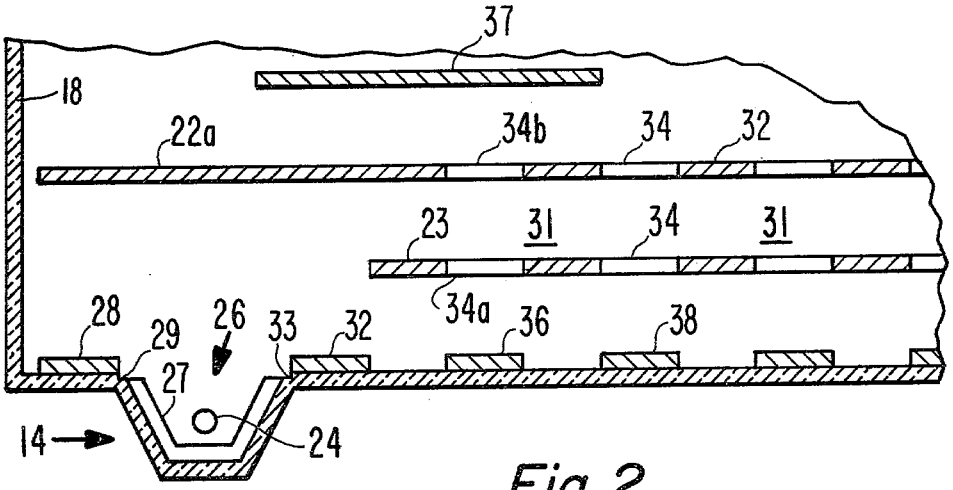
FIG. 2 is a cross sectional view of a preferred embodiment of the invention.
Figure 3:
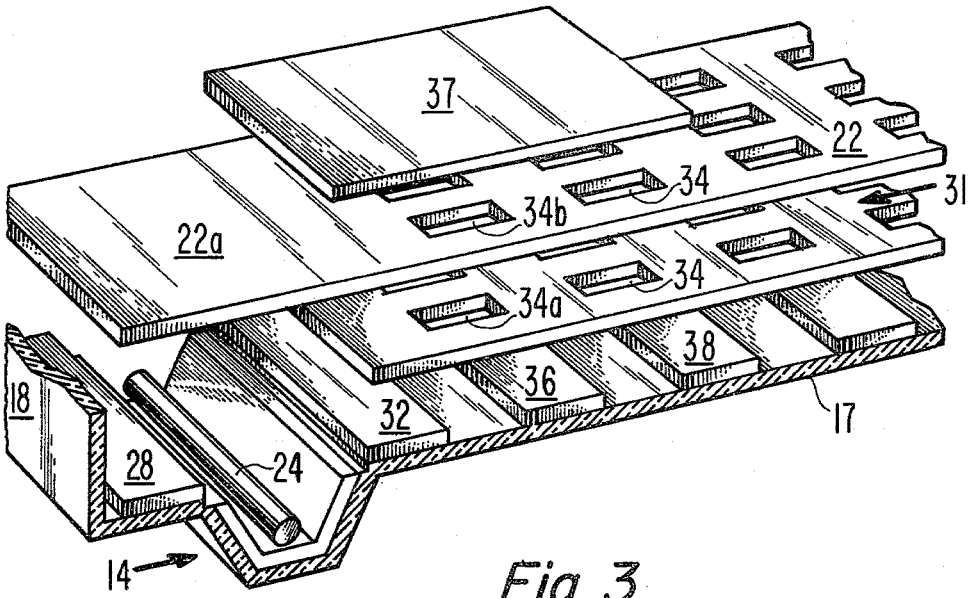
FIG. 3 is a perspective view, partially broken away, of the preferred embodiment shown in FIG. 2.

FIGS. 2 and 3 show the electron gun section 14 in greater detail. As shown particularly in FIG. 2, the electron gun section includes an elongated line cathode 24 positioned in a cavity 26. The cavity 26 is shown as trapezoidal in cross section, however, the configuration is not critical. A modulation electrode 27 is affixed to the inside wall of the cavity 26 such that the modulation electrode is symmetrical about the plane which passes through the cathode 24 and which is perpendicular to the internal surface 17*a* of the backwall 17.

An emission electrode 28 is juxtaposed to the modulation electrode 27 such that the two electrodes are substantially parallel across the transverse dimension of the channel 21. A small gap 29 is placed between the modulation electrode 27 and the emission electrode 28 to electrically separate the two electrodes. The modulation electrode 27 and the emission electrode 28 are individually biased so that electrons emanating from the cathode 24 can be emitted from, or retained within, the cavity 26 simply by adjusting either of both of the biasing potentials which are applied to these two electrodes. Typically, the emission electrode 28 is held at a fixed negative potential and the emission of electrons from the cathode is controlled by changing the negative potential on the modulation electrode 27. Accordingly, for any particular emission electrode potential the electron beam current is primarily determined by the level of the biasing potential applied to the modulation electrode 27. As an example, with the emission electrode biased at −45 volts about 4 microamps per mil of cathode length of beam current is obtained when the modulation electrode is set to −30 volts and gun cutoff occurs at −90 volts.

Two guide meshes 22 and 23 are separated from one another by a space 31 and are arranged parallel to the backwall 17. The guide mesh 22 has an extended portion 22*a* which extends beyond the cathode cavity 26. A launching electrode 32 is affixed to the internal surface of backwall 17 and extends transversely across the channel 21. The launching electrode 32 runs substantially parallel to the modulation electrode 27 and is electrically separated from the modulation electrode 27 by a space 33. The launching electrode 32 and the extended portion 22*a* are both positive biased with respect to the potential on the modulation electrode 27. The potential applied to the launching electrode 32 typically is substantially more positive than the potential applied to the extended portion 22*a*. As fully explained hereinafter, with reference to FIG. 4, the launching electrode 32 potential, the emission electrode 28 potential and the extended portion 22*a* potential form the electron optics which are used to launch the electrons emanating from the cathode 24 into the space 31 between the guide meshes 22 and 23. The optics which launch the electrons into the space 31, therefore, can be controlled by varying either or a combination of the positive potentials applied to the launching electrode 32 and the extended portion 22*a* and/or the emission electrode 28. The combination of the potentials which directs electrons into the space 31 is substantially independent of the potential on the modulation electrode 27 which controls the emission of electrons from the cavity 26. The device is typically operated with fixed potentials on electrodes 22*a*, 28 and 32, so that the electron beam current is determined primarily by the potential on the modulation electrode 27.

The electron gun section 14, constructed in the manner described hereinabove, has several distinct advantages over known electron gun sections. The maximum desired level of electron beam current, and the direction and spacial distribution of the velocities of the electrons within the space between the guide meshes can be optimized substantially independently of one another. For this reason, the transmission of electrons between the guide meshes at the maximum desired current level can be achieved with a minimum loss of electron beam current. Additionally, minor imperfections, which may exist in the guide structure can be compensated for by changing the focusing strength of the guide potentials without substantially compromising the conditions under which the electron beam is injected into the space between the guide meshes.

Another advantage stems from the fact that the electrodes 27 and 28, which determine the emission of electrons from the cathode, are affixed by deposition, or other techniques, to the backwall 17 and, therefore, the location tolerances of these electrodes are superior to the utilization of separately constructed electrodes. Another advantage is the utilization of a relatively high positive potential on the launching electrode 32. This higher potential increases the velocity of the electrons which are launched into the space 31 and, accordingly, any dimensional or configuration errors, which exist in the electron gun section elements, have less effect upon the electron beam because the beam is not exposed to the errors for as long a period of time as slower moving electrons would be.

As shown in FIGS. 2 and 3 the guide meshes 22 and 23 contain apertures 34 which are arranged in rows transversely across the guide meshes. The guide meshes 22 and 23 are interposed between a pair of lower and upper focusing electrodes 36 and 37, respectively. The focusing electrode 36 is affixed to the internal surface of the backwall 17 and is dimensioned to span an aperture 34*a* within the guide mesh 23. The upper focusing electrode 37 spans the aperture 34*b* in the guide mesh 22 and is dimensioned to extend past the aperture 34*b* along the extended portion 22*a*. The aperture 34*b* is slightly larger than the aperture 34*a*, and typically is smaller than the apertures 34 which form the propagation section of the display device. Typically, the focusing electrodes 36 and 37 are spaced equidistant from the guide meshes 23 and 22 and are biased to substantially the same potential. This biasing potential is higher than the positive potential which biases the guide meshses 22 and 23. Electrons which are directed into the space 31 by the electrostatic equipotentials created by the biasing potentials on the emission electorde 28, the launching electrode 32 and the extended portion 22*a* are converged, but thereafter have a tendency to spread apart up to, and extending into the space between the apertures 34*a* and 34*b*. The positive potentials applied to the focusing electrodes 36 and 37 respectively penetrate the apertures 34*a* and 34*b* to create an electrostatic field which focuses the electron beam between the guide meshes 22 and 23.

A plurality of extraction electrodes 38 are positioned beneath the apertures 34 and extend transversely across the channels 21. A high positive potential is applied to a focusing screen (not shown) which is positioned near the frontwall 16 and a positive potential is also applied to the extraction electrodes 38. These two potentials cooperate to form an electrostatic field through the apertures 34 to focus the electron beams as they propagate along the length of the channels 21 in the space 31 between the guide meshes 22 and 23.

Figure 4:
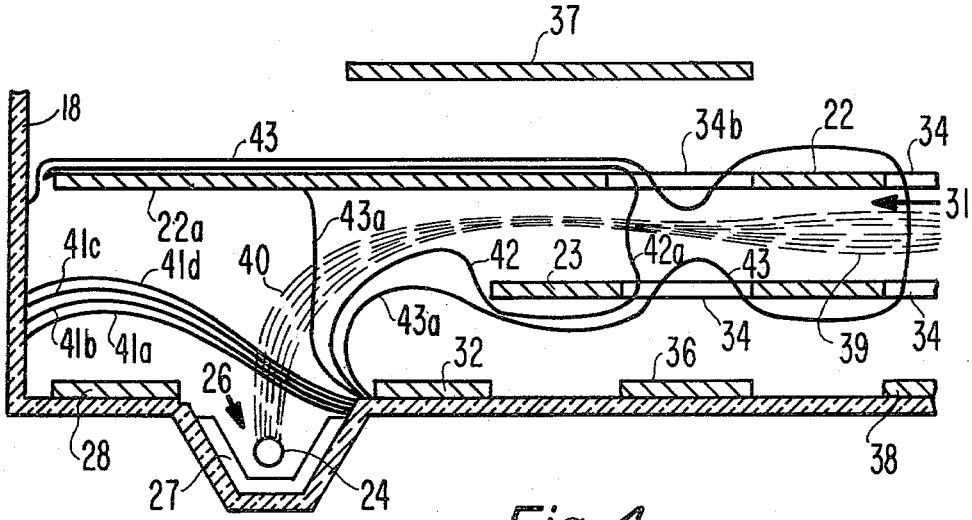
FIG. 4 is a cross sectional view showing the equipotentials established by different biasing potentials on the various electrodes of the inventive device.

The operation of the invention can be understood by referring to FIG. 4. As shown in FIG. 4 electrons of the beam 39 are emitted from the cathode 24 and follow a curved path 40 so that the electron beam is focused into the space 31 between the guide meshes 22 and 23 for propagation along the channel between the guide meshes.

The potentials applied to the modulation electrode 27, the launch electrode 32 and the emission electrode 28 control the emission of electrons from the cavity 26. Accordingly, by setting the launch electrode 32 to a fixed positive potential and the emission electrode 28 to a fixed negative potential, electrons can be retained within or emitted from, the cavity 26 by changing the potential applied to the modulation electrode 27.

The electrostatic equipotentials for fixed emission electrode, launch electrode and extended portion 22*a* biasing potentials are identified as 41*a* through 41*d* in FIG. 3. As an example, electrode 32 is +500 volts, electrode 28 −215 volts, and extended portion 22*a* −70 volts, for the particular equipotentials shown. The electrostatic equipotential 41*a* represents the zero volt equipotential line. The electrostatic equipotentials 41*b*, 41*c* and 41d, respectively, are the +10, +20 and +30 volt equipotential lines. The voltage level on the emission electrode 28 changes the spacial location of the equipotentials 41a thru 41d. An electron is deflected toward the perpendicular to the tangent of an electrostatic equipotential when it travels into a region of increasing positive potential. Therefore, the equipotentials 41a thru 41d change the angle at which the electron beam crosses the equipotential 43a. Since the curvature of the equipotentials 41a thru 41d is influenced by the potential on the emission electrode 28, this potential affects the direction of the electron beam into the space 31.

The curvature of the equipotentials 41a thru 41d is also influenced by the potential on the launch electrode 32. Therefore, the electrons emanating from the cavity 26 can be caused to follow the curved path 40 to enter the space 31 between the guide meshes 22 and 23 by biasing the launching electrode 32 at an appropriate high positive potential, for example +300 volts. The guide meshes 22 and 23 typically are biased at +70 volts. Accordingly, the extended portion 22a of the guide mesh 22 also is biased at a positive +70 volt potential. With the launching electrode 32 biased at a high positive potential the electrons leaving the cavity 26 obtain a high velocity and the electric field created by the biasing potentials on the extended portion 22a and the launching electrode 32 direct the beam 39 into the space 31 between the guide meshes 22 and 23. The direction of the electron beam into the space 31 between the guide meshes, therefore, is controlled substantially independently of the modulation electrode 27 potential which controls the level of emission of electrons from the cavity 26.

Because the potential applied to launching electrode 32 is a high positive potential the electrons obtain a high velocity and accordingly the time spent in the journey from the cathode 24 to the space 31 is a minimum. For this reason structural errors and other variations in the various elements of the device have a minimum effect on the electron beam. Additionally, the recessing of the cathode 24 into the cavity 26 increases the distance between the cathode and the guide meshes and also interrupts the line of sight from the cathode to the front edge of the lower guide mesh 23 and, therefore, heat from the cathode which ordinarily would tend to produce warpage and destroy structural tolerances of the thin metal grids has little, if any, effect on the guide meshes.

The edge of the aperture 34a nearest the cathode 24 in the guide mesh 23 is slightly displaced from the corresponding edge of the aperture 34b in the guide mesh 22. This causes the electrostatic equipotential 42 to include a somewhat tilted portion 42a. As is shown to those skilled in the art, an electron beam will cross into a region of higher potential in a direction which bends toward the perpendicular to the tangent of the equipotential. Accordingly, the portion 42a of the equipotential 42 and the equipotential 43 cause the electrons to bend slightly within the space 31 so that the electron beam travels substantially parallel to the two guide meshes 22 and 23.

The focusing electrodes 36 and 37 are arranged to span the two apertures 34a and 34b. These two electrodes are substantially equally spaced about the guide meshes 22 and 23 and are biased at substantially the same positive voltage, such as +350 volts. If desired, the focus electrode 37 can be placed at a distance from the guide mesh 22 which is different from the distance of the guide mesh 23 from the focusing electrode 36. When different spacing is used the biasing potential applied to the focusing electrode 37 is changed in value so that the electric field strength in the aperture 34b is comparable to that present when equal spacing is used. In this way the electron beam 39 is focused in the space 31 between the two guide meshes 22 and 23.

As the electron beam 39 passes between the first transverse row of the apertures 34, which are directly above the first extraction electrode 38, beam focusing is continued by balancing the electric field strengths due to the positive potential on the extraction electrode 38 and the high positive potential on the focusing screen (not shown) which is arranged along the viewing screen. Alternatively, the focusing screen may begin several apertures downstream from the cathode. In this case, the upper focusing electrode 37 is extended over several apertures 34b, and the potentials along the initial several extract electrodes adjusted to insure adequate initial focus. All of the extraction electrodes 38 are biased at the same potential so that the beam remains focused along the entire length of the channel 21. When it is desired to extract the electron beam 39 from the space 31 between the guide meshes 22 and 23, a negative potential is applied to one of the extraction electrodes. This negative potential directs the electron beam through the aperture 34 which is directly above the negatively biased extraction electrode and the beam travels toward the viewing screen (not shown) of the display device.

What is claimed is:

1. A flat panel display device comprising an evacuated envelope having a backwall and a plurality of channels extending along said backwall, guide means including spaced guide meshes arranged substantially parallel to said backwall for propagating electron beams along said channels in the space between said guide meshes; electron gun means positioned to emit electrons to said space, said electron gun means including a line cathode arranged substantially normal to said channels and positioned in a cavity so that the longitudinal axis of said cathode is displaced from the plane containing said space to emit electrons into curved paths along which said beams are converged into said space.

2. The display device of claim 1 wherein said electron gun means further includes at least one modulation electrode, said modulation electrode being arranged in said cavity and being symmetrical about a plane substantially normal to the plane of said backwall.

3. The display device of claim 2 wherein the guide mesh furtherest from said backwall is longer than the guide mesh closest to said backwall by an extended portion and wherein said extended portion extends beyond said cathode.

4. The display device of claim 3 wherein said guide meshes contain apertures arranged in transverse rows across said channels so that said rows are substantially parallel to said cathode, the apertures in the first row of said furtherest guide mesh being dimensionally different from the apertures in the first row of said closest guide mesh, and said first rows of apertures are the rows nearest said cathode.

5. The display device of claim 4 further including an emission electrode juxtaposed said modulation electrode to form emission control for emitting electrons from said cathode to said guide means, and further including a launching electrode arranged substantially parallel to said extended portion to form launching optics for launching said electrons into said space.

6. The display device of claim 3 further including an emission electrode juxtaposed to said modulation electrode to form emission control for emitting electrons from said cathode to said guide means, and further including a launching electrode arranged substantially parallel to said extended portion to form launching optics for launching said electrons into said space.

7. The display device of claim 3 further including a pair of focusing electrodes, said guide meshes being interposed between said focusing electrodes.

8. The display device of claim 7 wherein the focusing electrode furtherest from said backwall overlaps said extended portion.

9. The display device of claim 7 wherein said focusing electrodes are equally spaced about said guide meshes.

10. The display device of claim 8 further including an emission electrode juxtaposed to said modulation electrode to form emission control for emitting electrons from said cathode to said guide means, and further including a launching electrode arranged substantially parallel to said extended portion to form launching optics for launching said electrons into said space.

11. The display device of claim 8 further including an emission electrode juxtaposed to said modulation electrode to form emission control for emitting electrons from said cathode to said guide means, and further including a launching electrode arranged substantially parallel to said extended portions to form launching optics for launching said electrons into said space.

12. An electron gun for providing electrons to an electron receiving means comprising:

line cathode means for emitting electrons, said cathode means being arranged in a cavity and displaced from the plane containing said electron receiving means so that electrons are directed to said receiving means along curved paths which converge toward said receiving means;

modulation electrode means affixed to the wall of said cavity in the proximity of said cathode means, said modulation means being voltage biased to effect the emission of electrons from said cathode means;

launch electrode means in the vicinity of said cathode means for creating a first electrostatic equipotential field, in the vicinity of said cathode means;

focus electrode means in the vicinity of said launch electrode means for creating a second electrostatic equipotential field in the vicinity of said cathode means, said first and second equipotential fields forming electron optics to direct electrons along said curved paths to converge toward said electron receiving means.

13. The electron gun of claim 12 further including emission electrode means arranged in the proximity of said modulation electrode means and wherein said modulation electrode means and said emission electrode means are parallel to said cathode and are on opposite sides of said cathode.

14. The electron gun of claim 12 wherein said modulation electrode means is symmetrically disposed with respect to said cathode means.

15. The electron gun of claim 12 further including emission electrode means arranged in the proximity of said modulation electrode means and being voltage biased with a fixed potential, so that said modulation means and said emission electrode means coact to control the emission of electrons from said cathode.

* * * * *

UNITED STATES PATENT AND TRADEMARK OFFICE
CERTIFICATE OF CORRECTION

PATENT NO. : 4,308,486

DATED : December 29, 1981

INVENTOR(S) : Robert Gange

It is certified that error appears in the above-identified patent and that said Letters Patent is hereby corrected as shown below:

Column 4, line 28, "electorde" should read --electrode--.

Column 4, line 65, "22a - 70" should read --22a + 70--.

Column 7, claim 10, line 1, "8" should read --7--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*